United States Patent [19]

Reynolds et al.

[11] Patent Number: 4,580,584

[45] Date of Patent: Apr. 8, 1986

[54] CIGARETTE FILTER

[75] Inventors: Martin L. Reynolds; Dorothy M. Frank; Tilford F. Riehl, all of Louisville, Ky.

[73] Assignee: Brown & Williamson Tobacco Corporation, Louisville, Ky.

[21] Appl. No.: 581,516

[22] Filed: Feb. 21, 1984

[51] Int. Cl.[4] ..... A24D 3/04

[52] U.S. Cl. ..... 131/336; 131/340; 131/341; 131/361

[58] Field of Search ..... 131/336, 340, 339, 341, 131/361

[56] References Cited

U.S. PATENT DOCUMENTS

| | | | |
|---|---|---|---|
| 3,010,457 | 11/1961 | Schubert | 131/361 |
| 3,356,094 | 12/1967 | Ellis et al. | 131/361 |
| 3,396,733 | 8/1968 | Allseits et al. | 131/339 |
| 4,022,222 | 5/1977 | Berger | 131/340 |
| 4,342,322 | 8/1982 | Sanford | 131/339 |
| 4,343,319 | 8/1982 | Cantrell | 131/339 |
| 4,481,959 | 11/1984 | Byrne | 131/361 |

*Primary Examiner*—Vincent Millin
*Assistant Examiner*—H. Macey
*Attorney, Agent, or Firm*—Charles G. Lamb

[57] ABSTRACT

A filter for a cigarette includes a porous filter rod having a capillary smoke passageway extending coaxially therethrough. The filter rod is circumscribed by a non-porous wrapper and the filter rod with the non-porous wrapper therearound is provided with at least one groove extending from one end thereof a preselected distance longitudinally therealong. The groove preferably extends from the mouth end of the filter rod. Tipping material circumscribes the non-porous wrapper and is provided with flow-through openings therein in flow communication with the groove. In one embodiment, the filter rod includes a cylindrical collar coaxially located at the mouth end defining a recess, the thickness of the wall of the collar being less than the depth of the groove. In a further embodiment, the filter collar includes a concentric open core member coaxial with and open to the capillary flow passageway with the area between the core member and collar wall being open to the groove. In a still further embodiment, the filter rod includes a cylindrical filter collar located at the mouth end defining a recess, the filter collar covering the open end of the groove at the mouth end of the filter rod.

8 Claims, 7 Drawing Figures

CIGARETTE FILTER

BACKGROUND OF THE INVENTION

1. Field of the Invention

This invention relates to filters for cigarettes. In one aspect it relates to a recessed filter with ventilating means therein. In even another respect the invention relates to a filter for a cigarette having smoke directing means therein in combination with ventilating air means.

2. Description of the Prior Art

It is well known in the art to add filters to cigarettes wherein the filters are provided with ventilating means to bring ambient air into the filter to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough, thereby diluting the smoke in the stream. Also, the cigarette wrapper may be perforated at selected locations along the length of the cigarette which provides ports for the cigarette through which ventilating air enters. Even further, it is known to perforate the wrapper of the filter for dilution of the smoke stream. There have also been a number of suggestions for incorporating grooves within the filter plug for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by a tipping paper having flow-through perforations therein whereby ventilating air enters directly into the filter element or progresses down the grooves to the smoker's mouth. Other patents which relate to cigarette filters having grooves circumscribing the filter element for the introduction of ventilating air into the filtering end of the filter cigarette include U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; West German Pat. No. 2,302,677; British Pat. No. 1,414,745; British Pat. No. 1,360,612; British Pat. No. 1,360,611; and, U.S. Pat. No. 3,910,288, the aforementioned British patents being directed to non-wrapped acetate filters. Furthermore, there are a number of patents directed to the incorporation of centrally disposed tubes into a cigarette filter. These include, for example, U.S. Pat. No. 3,860,011; U.S. Pat. No. 4,037,524; U.S. Pat. No. 4,086,846; U.S. Pat. No. 4,022,221; U.S. Pat. No. 3,045,680; U.S. Pat. No. 3,621,851; U.S. Pat. No. 3,674,036; U.S. Pat. No. 4,109,666; and U.S. Pat. No. 4,256,122. Further, U.S. Pat. No. 4,380,241 relates to a non-filtering cigarette mouthpiece including a centrally disposed smoke flow tube.

SUMMARY OF THE INVENTION

The present invention advantageously provides a straight forward arrangement of a filter for a cigarette which in one form achieves normal cigarette pressure drop with low to high efficiency filters. The present invention further provides a cigarette filter for lower tar by ventilation as well as filtration. The present invention even further provides a filter ventilation system for a cigarette utilizing grooves in the filter plug extending from tipping perforations in the tipping paper to the mouth end of the filter. The present invention also provides a grooved filter with a non-porous plug wrap. The present invention even also provides means for directing an unfiltered, undiluted smoke stream through a filter to the center thereof and simultaneously therewith provides means for directing ventilating air along the outer surface thereof.

Various other features of the present invention will become obvious to those skilled in the art upon reading the disclosure set forth hereinafter.

More particularly, the present invention provides a filter for a cigarette comprising a porous filter rod of cylindrical configuration having a smoke flow capillary passageway formed concentrically with the longitudinal axis of the filter rod and extending longitudinally therethrough; an impervious wrapper extending longitudinally along said rod and circumscribing said rod leaving flow-through opposed ends of said rod, said wrapper having at least one longitudinally extending groove embedded into the filter rod and that portion of the wrapper defining the groove remaining impervious, said at least one groove being open ended at and extending from the mouth end of the rod a distance less than the length of the filter; and, tipping material extending longitudinally of and circumscribing said wrapper, said tipping material extending a preselected distance beyond the mouth end of the filter rod thereby defining a recess at the mouth end of the filter, said tipping material including means to introduce ventilating air into said groove, said ventilating air being the only fluid flowing through said groove when the filter is used in combination with a cigarette during normal smoke draw.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
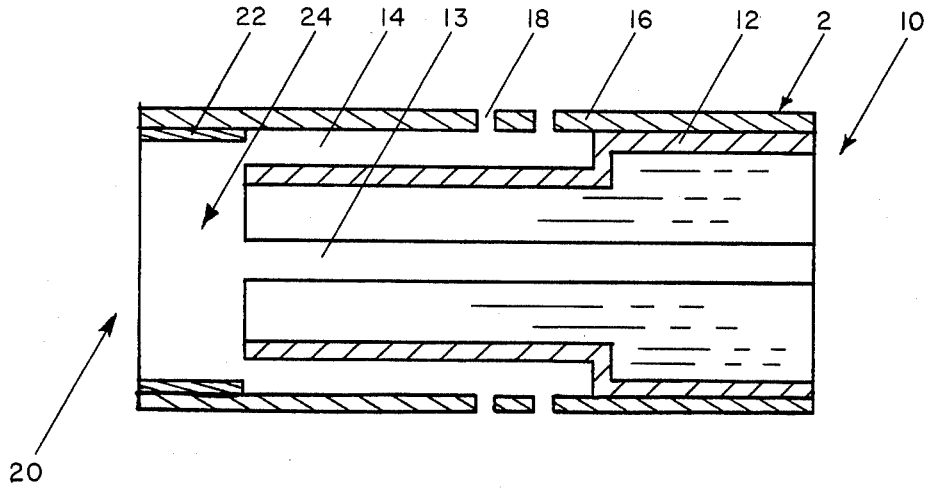
FIG. 1 is a cross-sectional view of one preferred filter element of the present invention.
Figure 2:
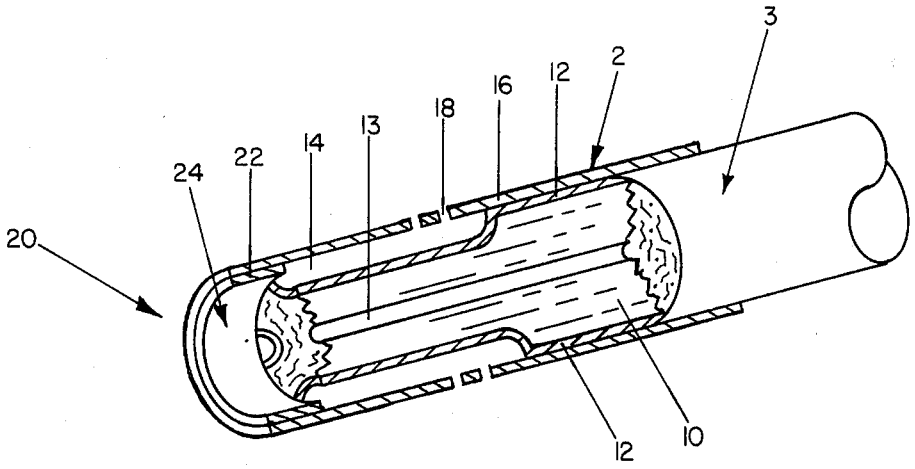
FIG. 2 is a perspective view, with selected portions cut-away, of the filter element of FIG. 1 attached to a cigarette.

In FIGS. 1 and 2, a filter plug 2 of the present invention is shown. This filter plug 2 comprises a cellulose acetate filter element 10 or any other filter made from fibrous or foamed materials for tobacco smoke which may be known in the art circumscribed by a non-porous wrapper 12. It is realized that in the use of the term "non-porous wrapper", this includes non-porous outer surfaces of foamed material which are integral with the filter element as well as non-porous wrapping material which is not integral with the filter element. A smoke flow capillary passageway 13 is formed concentrically with the longitudinal axis of the filter element 10 extending longitudinally from one end (tobacco end) to the other end (mouth end) of the filter element 10. The smoke flow capillary passageway 13 can, for example, be an extrusion. The wall of the capillary passageway 13 can be either pervious or impervious. Furthermore, the filter plug 2 is provided with a plurality of grooves 14 therein extending longitudinally therealong from the mouth end of filter element 10 a predetermined distance less than the entire length of the filter element 10. The filter plugs 2 are generally prepared by taking a standard filter rod of cellulose acetate or the like, wrapping the rod with a non-porous wrapping material, then subjecting the wrapped filter rod to a mold or other treating means designed for putting appropriate grooves therein. One such method is known as a heat molding technique, which is well known in the art.

In FIG. 2, the filter plug 2 is attached to a tobacco column or cigarette 3 and is positioned for being wrapped by tipping paper 16 which includes a plurality of perforations 18 therein circumferentially surrounding filter plug 2 and disposed for alignment with the grooves 14 wherein ventilating air radially enters the grooves 14 through the perforations 18. It is realized that in the use of the term "tipping paper" this may include commercially available tipping paper in combination with an air permeable wrapper which is used in the assembly of the filter prior to attachment to a tobacco column. As shown in FIGS. 1 and 2, ventilating air enters through the tipping perforations 18 traveling down the grooves 14 and toward the smoker's mouth. The smoke flow capillary passageway 13 is disposed to concentrate the smoke in the central portion of the filter plug 2 for directing a stream of unfiltered, undiluted smoke toward the mouth of the smoker.

With continued reference to FIGS. 1 and 2, the filter plug 2 further includes a collar 20 defined by a thin, substantially cylindrical wall 22. The collar 20 is located at the mouth end of the filter element 10 coaxial therewith, thus, providing for a recess 24 at the mouth end of the filter element 10. The outside diameter of the cylindrical collar wall 22 is generally equal to the diameter of the filter plug 2, and the inside diameter of the collar wall 22 is large enough so as to leave at least a portion of the open ends of the grooves 14 at the mouth end of the filter element 10 open to the recess 24. That is, the thickness of the cylindrical wall 22 is less than the depth of a groove 14. The collar 20 is affixed to the filter element 10 by the tipping paper 16 which extends past the mouth end of the filter plug 2 in circumferential overlapping relationship to the outside surface of the collar wall 22. Preferably, the cylindrical wall 22 is fabricated of an impermeable material such as a plastic.

When the cigarette 3 is smoked, unfiltered, undiluted smoke flows through the capillary passageway 13 in a concentrated stream which passes through the recess 24. At the same time, smoke passes through the body of the filter element 10 whereupon it is filtered and passes through the recess 24. Concurrently, ventilating air from the grooves 14 also passes through the recess 24.

Figure 3:
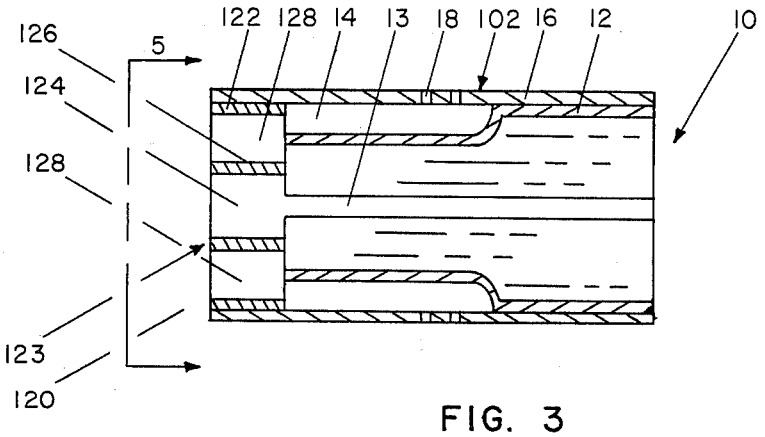
FIG. 3 is a perspective view with selected portions cut-away, of another preferred filter element of the present invention.
Figure 4:
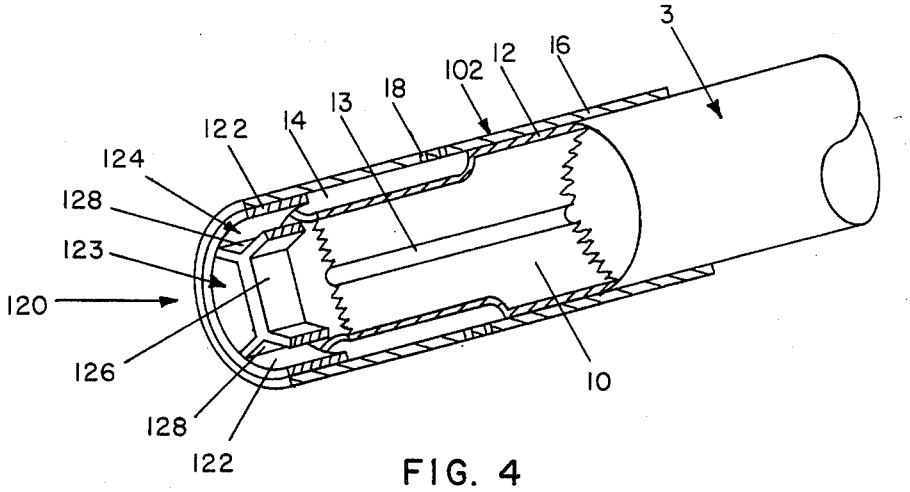
FIG. 4 is a perspective view, with selected portions cut-away, of the filter element of FIG. 3 attached to a cigarette.
Figure 5:
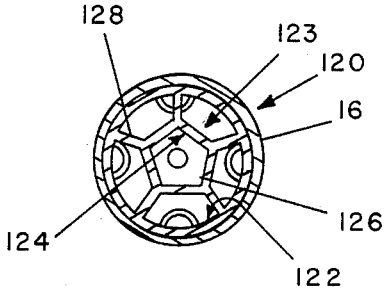
FIG. 5 is an end view of the filter element of FIG. 3 as viewed in the direction of arrows 5—5 in FIG. 3.

FIGS. 3 through 5 illustrate a filter plug 102 which has many features in common with the filter plug 2 of FIGS. 1 through 2. The common features are denoted by identical numerals in FIGS. 1 through 5, and for the sake of brevity they will not be described again. With reference to FIGS. 3 through 5, the filter plug 102 includes a collar 120 defined by a thin, substantially cylindrical wall 122 and an open work structure, generally denoted as the numeral 123, located within the cylindrical wall 122. The collar 120 is located at the mouth end of the filter element 10 coaxial therewith, thus, providing for a recess 124 at the mouth end of the filter element 10. The outside diameter of the collar wall 122 is generally equal to the diameter of the filter element 10, and the inside diameter of the collar wall 122 is large enough so as to leave at least a portion of the open ends of the grooves 14 at the mouth end of the filter element 10 open to the recess 124. That is, the thickness of the cylindrical wall 122 is less than the depth of a groove 14. The open work structure 123 is shown as including a central open core 126 of thin wall construction concentrically disposed within the collar wall 122 and webs 128 extending between and interconnecting the hollow core 126 and cylindrical collar wall 122. The thin wall construction of the open core 126 is illustrated as defining a pentagon in end view (see FIG. 5) with the webs 128 extending from the apexes to the inside surface of the cylindrical collar wall 122. The open core 126 is generally coaxial with the smoke flow capillary passageway 13 at the mouth end of the filter element 10, and the webs 128 each radially extend between adjacent open ends of the grooves 14 at the mouth end of the filter element 10. Preferably, the collar 120 is fabricated of an impermeable material such as, for example, a plastic.

When the cigarette 3 is smoked, unfiltered, undiluted smoke flows through the capillary passageway 13 in a concentrated stream which passes through the portion of the recess 124 defined by the open core 126 of the collar 120. At the same time, smoke passes through the body of the filter element 10 whereupon it is filtered. A portion of this filtered smoke passes through the portion of the recess 124 defined by the open core 126 of the collar 120, and another portion of this filtered smoke passes through the other portion of the recess 124 defined between the core 126 and collar wall 122. Concurrently, ventilating air from the grooves 14 also passes through the other portion of the recess 124 defined between the core 126 and collar wall 122.

Figure 6:
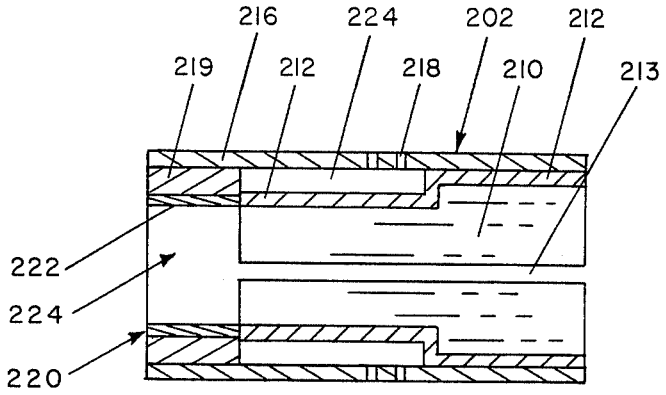
FIG. 6 is a cross-sectional view of yet another preferred filter element of the present invention; and, FIG. 7 is a perspective view, with selected portions cut-away, of the filter element of FIG. 6 attached to a cigarette.
Figure 7:
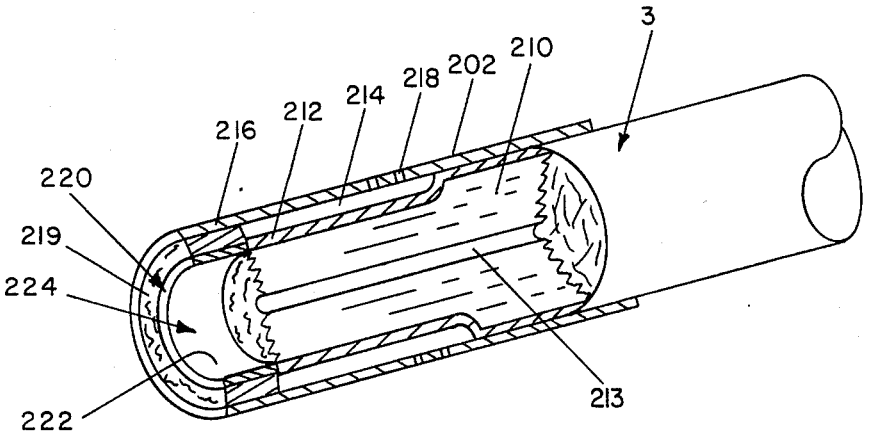

FIGS. 6 and 7 show another filter plug of the present invention, the filter plug being identified by the number 202. This filter plug 202 includes a cellulose acetate filter element 210 or any other filter element made from fibrous or foamed materials for tobacco smoke, and is circumscribed by a non-porous wrapper 212. A smoke flow capillary passageway 213 is formed concentrically with the longitudinal axis of the filter element 210 extending longitudinally from one end (tobacco end) to the other end (mouth end) of the filter element 210. Further, the filter plug 202 is provided with a plurality of grooves 214 extending longitudinally therealong from the mouth end of the filter element 210 a predetermined distance less than the entire length of the filter element 210.

In FIGS. 6 and 7, the filter plug 202 is attached to a tobacco column or cigarette 13 and is circumferentially wrapped with tipping paper 216 which includes a plurality of perforations 218 therein circumferentially surrounding filter plug 202 and disposed for flow-through alignment with the grooves 214. As shown in FIGS. 6 and 7, ventilating air enters through the tipping perforations 218 traveling down the grooves 214 and toward the smoker's mouth. The smoke flow capillary passageway 213 is disposed to concentrate the smoke in the central portion of the filter plug 202 for directing a stream of unfiltered, undiluted smoke toward the smoker's mouth.

With continued reference to FIGS. 6 and 7, the filter plug 202 further includes a coaxially disposed cylindrical band 219 of filter material at the mouth end of the filter element 210. The inner surface of the cylindrical band 219 defines a recess 224 at the mouth end of the filter element. The band 219 can be fabricated of fibrous or foamed materials known in the art, such as, for example, cellulose acetate. The outside diameter of the cylindrical filter band 219 is generally equal to the diameter of the filter element 210, and the inside diameter of the cylindrical filter ban 219 is small enough so that the open ends of the grooves 214 at the mouth end of the filter element 210 are covered by the filter band 219. That is, the wall of the cylindrical band 219 is at least as thick as the depth of a groove 214. In addition, a collar 220 defined by a thin, substantially cylindrical wall 222 is concentrically located within the filter band 219. The outside diameter of the collar wall 222 is substantially equal to the inside diameter of the filter band 219. Preferably, the collar 220 is fabricated of an impermeable material, such as a plastic, and the filter band 219 is held in place with the collar 220. The cylindrical band 219 of filter material is affixed to the filter element 210 by the tipping paper 216 which extends past the mouth end of the filter rod 202 in circumferential overlapping relationship to the outside surface of the cylindrical band 219.

When the cigarette 3 is smoked, unfiltered, undiluted smoke flows through the capillary passageway 213 in a concentrated stream which passes through the recess 224 and into the smoker's mouth. At the same time, most of the smoke passing through the recess 224 into the smoker's mouth and smoke moving through the filter element 210 in the areas thereof between adjacent grooves 214 moves through the cylindrical filter band 219. Ventilation air flows in the grooves 214 and into the cylindrical filter band 219 wherein it at least partially mixes with the smoke also moving through the cylindrical filter band 219, and flows from the filter band 219 into the smoker's mouth.

It will be realized that various changes may be made to the specific embodiments shown and described without departing from the principles of the present invention.

What is claimed is:

1. A filter for a cigarette comprising:

a porous filter rod of cylindrical configuration having a smoke flow capillary passageway formed concentrically with the longitudinal axis of the filter rod and extending longitudinally therethrough;

an impervious wrapper extending longitudinally along said rod and circumscribing said rod leaving flow-through opposed ends of said rod, said wrapper having at least one longitudinally extending groove embedded into the filter rod and that portion of the wrapper defining the groove remaining impervious, said at least one groove being open ended at and extending from the mouth end of the rod a distance less than the length of the filter rod;

tipping material extending longitudinally of and circumscribing said wrapper, said tipping material extending a preselected distance beyond the mouth end of the filter rod thereby defining a recess at the mouth end of the filter, said tipping material including means to introduce ventilating air into said groove, said ventilating air being the only fluid flowing through said groove when the filter is used in combination with a cigarette during normal smoke draw; and, a coaxially disposed collar in said recess, said collar being radially spaced inwardly from said tipping material with filter material disposed in the space between the tipping material and the collar.

2. The filter of claim 1, wherein the filter material in the space between the tipping material and the collar covers the open end of the at least one groove at the mouth end of the filter rod.

3. A filter for a cigarette comprising:

a porous filter rod of cylindrical configuration having a smoke flow capillary passageway formed concentrically with the longitudinal axis of the filter rod and extending longitudinal therethrough;

an impervious wrapper extending longitudinally along said rod and circumscribing said rod leaving flow-through opposed ends of said rod, said wrapper having at least one longitudinally extending groove embedded into the filter rod and that portion of the wrapper defining the groove remaining impervious, said at least one groove being open ended at and extending from the mouth end of the rod a distance less than the length of the filter rod;

tipping material extending longitudinally of and circumscribing said wrapper, said tipping material extending a preselected distance beyond the mouth end of the filter rod thereby defining a recess at the mouth end of the filter, said tipping material including means to introduce ventilating air into said groove, said ventilating air being the only fluid flowing through said groove when the filter is used in combination with a cigarette during normal smoke draw; and, a generally cylindrical band of filter material coaxially disposed in said recess, the band of filter material covering the open end of the at least one groove at the mouth end of the filter rod.

4. A filter for a cigarette comprising:

a porous filter rod of cylindrical configuration having a smoke flow capillary passageway formed concentrically with the longitudinal axis of the filter rod and extending longitudinally from one end to the other end of the filter rod;

an impervious wrapper extending longitudinally along said rod and circumscribing said rod leaving flow-through opposed ends of said rod, said wrapper having at least one longitudinally extending groove embedded into the filter rod and that portion of the wrapper defining the groove remaining impervious, said at least one groove being open ended at and extending from the mouth end of the rod a distance less than the length of the filter rod;

a generally cylindrical band of filter material coaxially located at the mouth end of the filter rod, the inside wall surface of the cylindrical filter band defining a recess at the mouth end of the filter rod, and the filter band covering the open end of the at least one groove at the mouth end of the filter rod; and, tipping material extending longitudinally of and circumscribing wrapper and circumscribing the cylindrical filter band, said tipping material being air pervious and permitting ventilating air flow therethrough into said groove, said ventilating air being the only fluid flowing through said groove when the filter is used in combination with a cigarette during normal draw.

5. The filter of claim 4, wherein the wall of the filter band is at least as thick as the depth of the groove at the mouth end of the filter rod.

6. The filter of claim 4, further comprising a collar concentrically located within the cylindrical filter band, the outside diameter of the collar being substantially equal to the inside diameter of the filter band.

7. The filter of claim 6, wherein the filter band is attached to the collar.

8. The filter of claim 6, wherein the collar wall is impermeable.

* * * * *